US007638700B1

(12) United States Patent
Heintz

(10) Patent No.: US 7,638,700 B1
(45) Date of Patent: Dec. 29, 2009

(54) MOUTHPIECE FOR SINGLE REED WOODWIND INSTRUMENT

(75) Inventor: David G. Heintz, Pike, NH (US)

(73) Assignee: Clarflupet, LLC, Pike, NH (US)

( * ) Notice: Subject to any disclaimer, the term of this patent is extended or adjusted under 35 U.S.C. 154(b) by 0 days.

(21) Appl. No.: 12/326,978

(22) Filed: Dec. 3, 2008

Related U.S. Application Data

(60) Provisional application No. 61/013,139, filed on Dec. 12, 2007.

(51) Int. Cl.
*G10D 9/02* (2006.01)

(52) U.S. Cl. ..... 84/398; 84/383 A

(58) Field of Classification Search ..... 84/380 R, 84/385 R, 385 A, 398, 399
See application file for complete search history.

(56) References Cited

U.S. PATENT DOCUMENTS 2,504,547 A 4/1950 Legler
3,191,483 A * 6/1965 Williams ..... 84/398
4,517,875 A 5/1985 Dossekker
4,596,175 A 6/1986 Dossekker
6,747,198 B1 6/2004 Sullivan
7,220,903 B1 5/2007 Bronen
7,465,864 B2 12/2008 Heintz

* cited by examiner

*Primary Examiner*—Kimberly R Lockett
(74) *Attorney, Agent, or Firm*—McLane, Graf, Raulerson & Middleton, P.A.; Scott C. Rand

(57) ABSTRACT

A reed mouthpiece for single reed woodwind musical instrument comprises a mouthpiece body defining an air passageway. A reed placement surface is defined on the mouthpiece body adjacent the air passageway. A reed retaining body is formed on the mouthpiece body for removably securing a reed to the mouthpiece includes first and second upstanding walls and a transverse portion extending therebetween. The reed retaining body and reed placement surface define an axially extending channel for receiving a heel end of the reed. The transverse portion includes a tapped opening rotatably receiving a threaded fastener. The threaded fastener may be selectively advanced toward the reed placement surface by rotating in one direction and retracted away from the reed placement surface by rotating in the opposite direction to allow selective engagement and disengagement of the reed. A shoulder is provided axially adjacent the reed placement surface to prevent passage of the reed completely through the axially extending channel.

15 Claims, 8 Drawing Sheets

10
12
14
16
20
24
26
28
30
32
34
36
38
40
42
44
46
48
50
52
54
58
60
A
B
C

MOUTHPIECE FOR SINGLE REED WOODWIND INSTRUMENT

CROSS REFERENCE TO RELATED APPLICATION

This application claims the benefit of priority based on U.S. provisional application No. 61/013,139 filed Dec. 12, 2007. The aforementioned provisional application is incorporated herein by reference in its entirety.

BACKGROUND

The present disclosure relates to musical instruments and, more particularly, to an improved mouthpiece for single reed woodwind instruments, such as clarinets and saxophones, which use a moistened reed, such as a cane reed or the like.

Single reed instrument mouthpieces generally require that the reeds be repeatedly removed from and attached to the mouthpiece. Single reeds are attached just before playing since it is necessary to moisten the reed, typically by holding the reed in the players' mouth, before it is attached to the mouthpiece. Similarly, it is advisable to remove the reed from the mouthpiece after playing since leaving a wet reed on the mouthpiece to dry may cause warping and thereby making it difficult to achieve a good tone.

Conventional single reed ligatures comprise metal bands encircling the mouthpiece which are tightened using a plurality of screws. The conventional ligatures are separate from the mouthpiece body and it can therefore be difficult to correctly position the reed and tighten the ligature. This is particularly so for persons who are not prone to precise manipulations, or persons who are simply not accustomed to attaching and removing a reed to a mouthpiece.

The embodiments described herein are particularly advantageous for use by young children, beginning single reed woodwind instrument students, and disabled persons. However, it will be recognized that the present mouthpiece may be advantageously used by single reed woodwind players of any age or playing ability.

SUMMARY

A reed mouthpiece for a single reed woodwind musical instrument comprises a mouthpiece body defining an air passageway extending therethrough. A reed placement surface is defined on the mouthpiece body adjacent the air passageway. A reed retaining body is formed on the mouthpiece body for removably securing a reed to the mouthpiece and includes first and second upstanding walls and a transverse portion extending therebetween. The reed retaining body and reed placement surface define an axially extending channel for receiving a heel end of the reed. The transverse portion includes a tapped opening rotatably receiving a threaded fastener. The threaded fastener may be selectively advanced toward the reed placement surface by rotating in one direction and retracted away from the reed placement surface by rotating in the opposite direction to allow selective engagement and disengagement of the reed. A shoulder is provided axially adjacent the reed placement surface to prevent passage of the reed completely through the axially extending channel. In an especially preferred embodiment, the shoulder is axially displaced rearwardly from the axially extending channel a sufficient distance to permit manual adjustment of the reed position on the reed placement surface using the heel end of the reed and sufficiently close to the front of the mouthpiece so as to keep the vamped area of the reed from entering the channel.

BRIEF DESCRIPTION OF THE DRAWINGS

The invention may take form in various components and arrangements of components, and in various steps and arrangements of steps. The drawings, wherein like reference numerals are used for like components throughout the several views, are only for purposes of illustrating preferred embodiments and are not to be construed as limiting the invention.

DETAILED DESCRIPTION OF THE PREFERRED EMBODIMENTS

Although the present invention will be described with reference to the embodiments shown in the figures, it should be understood that the present invention may have many alternate forms.

This application involves single reed instrument mouthpieces for single reed woodwind instruments, such as woodwind instruments in the clarinet and saxophone families. The mouthpieces herein may also be used as a single reed mouthpiece with training instruments of the type disclosed in U.S. patent application Ser. No. 11/582,174, filed on Oct. 17, 2006, now U.S. Pat. No. 7,465,864, entitled "Musical Instrument Training Device with Multiple Mouthpieces," which is owned in common with the subject application. The entire disclosure of the cited application is incorporated herein by reference.

Figure 1:
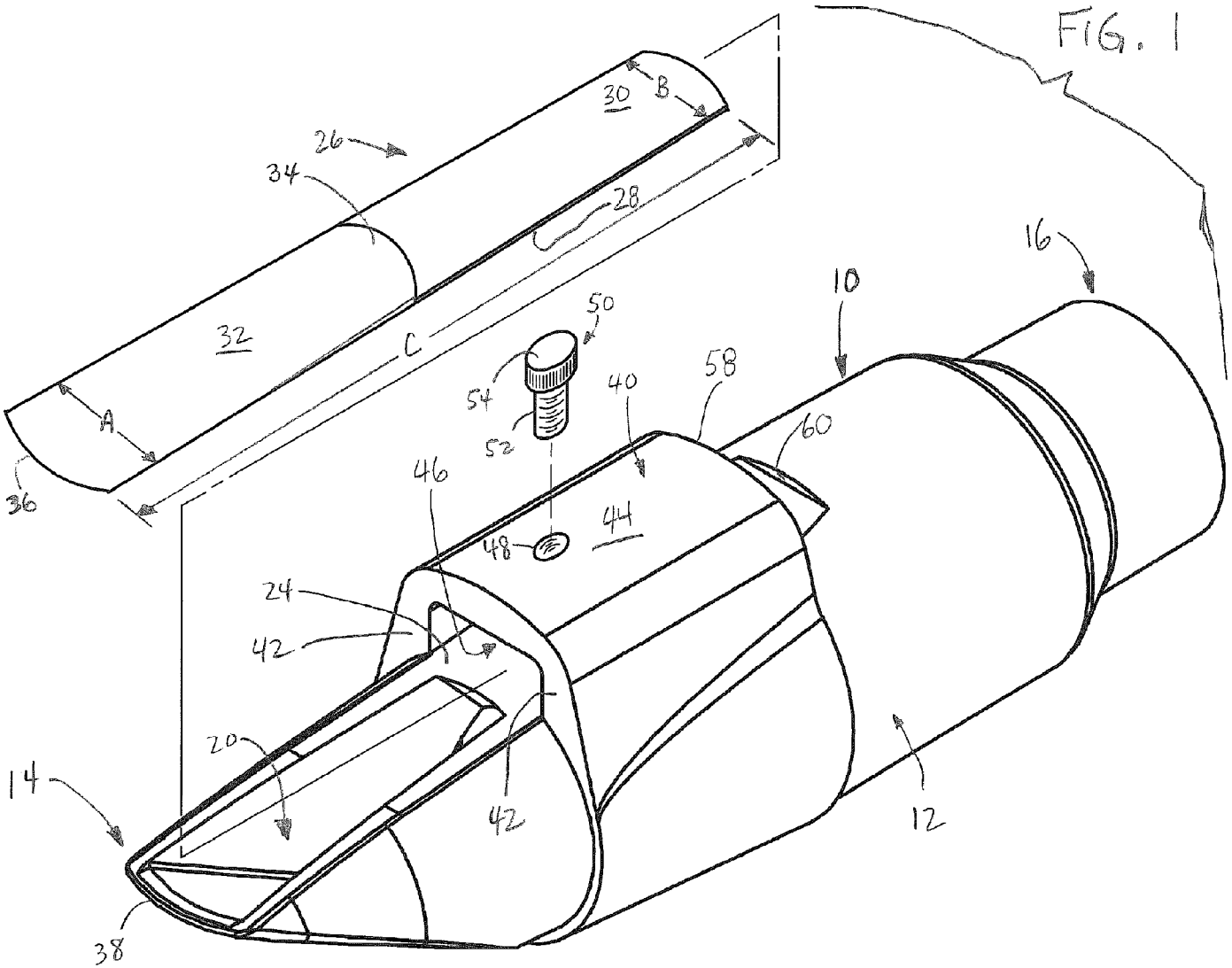
FIG. 1 is an exploded, isometric view of a mouthpiece and reed assembly in accordance with an exemplary embodiment of the present invention, taken generally from above and from the front.
Figure 2:
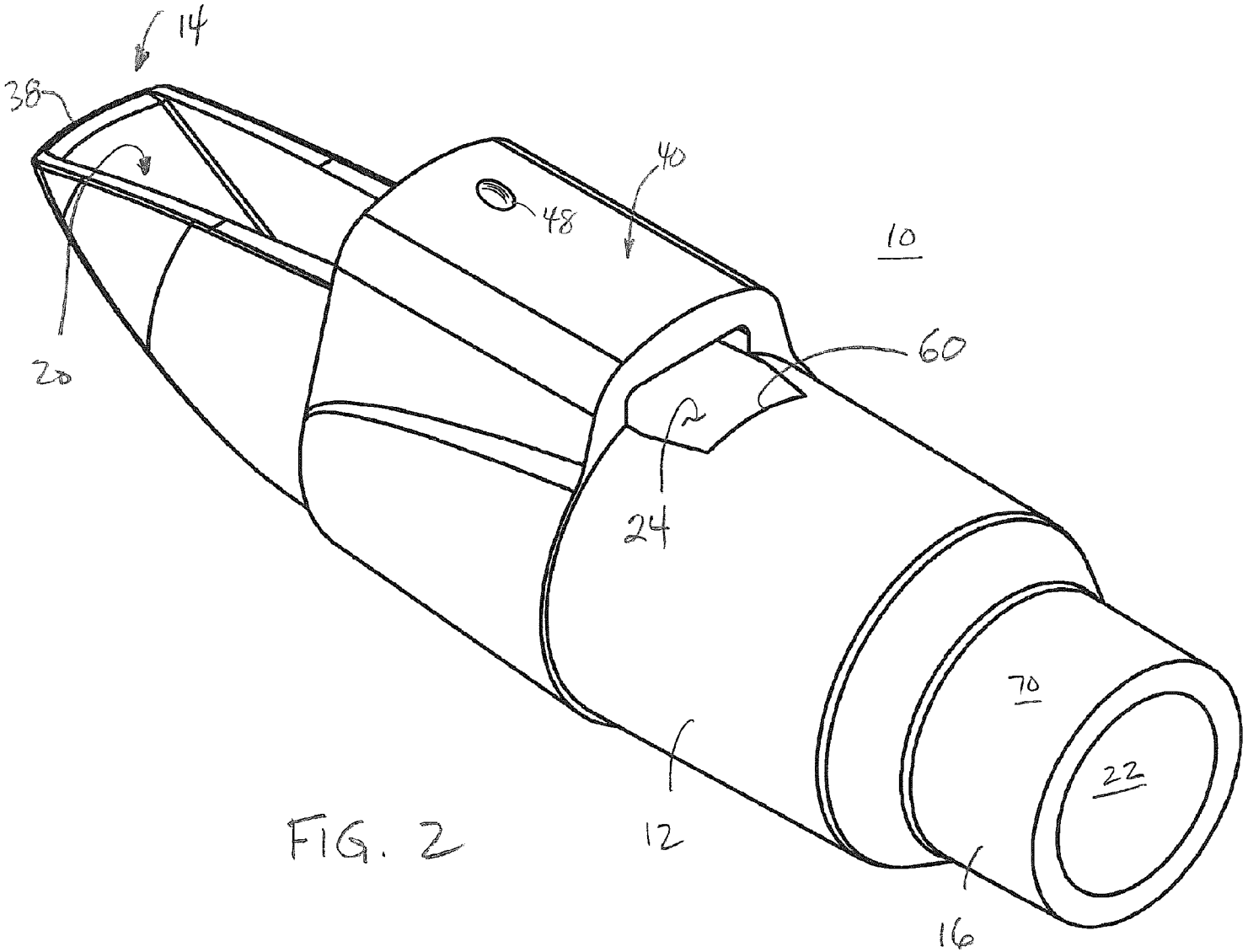
FIG. 2 is an isometric view of the mouthpiece body shown in FIG. 1.
Figure 3:
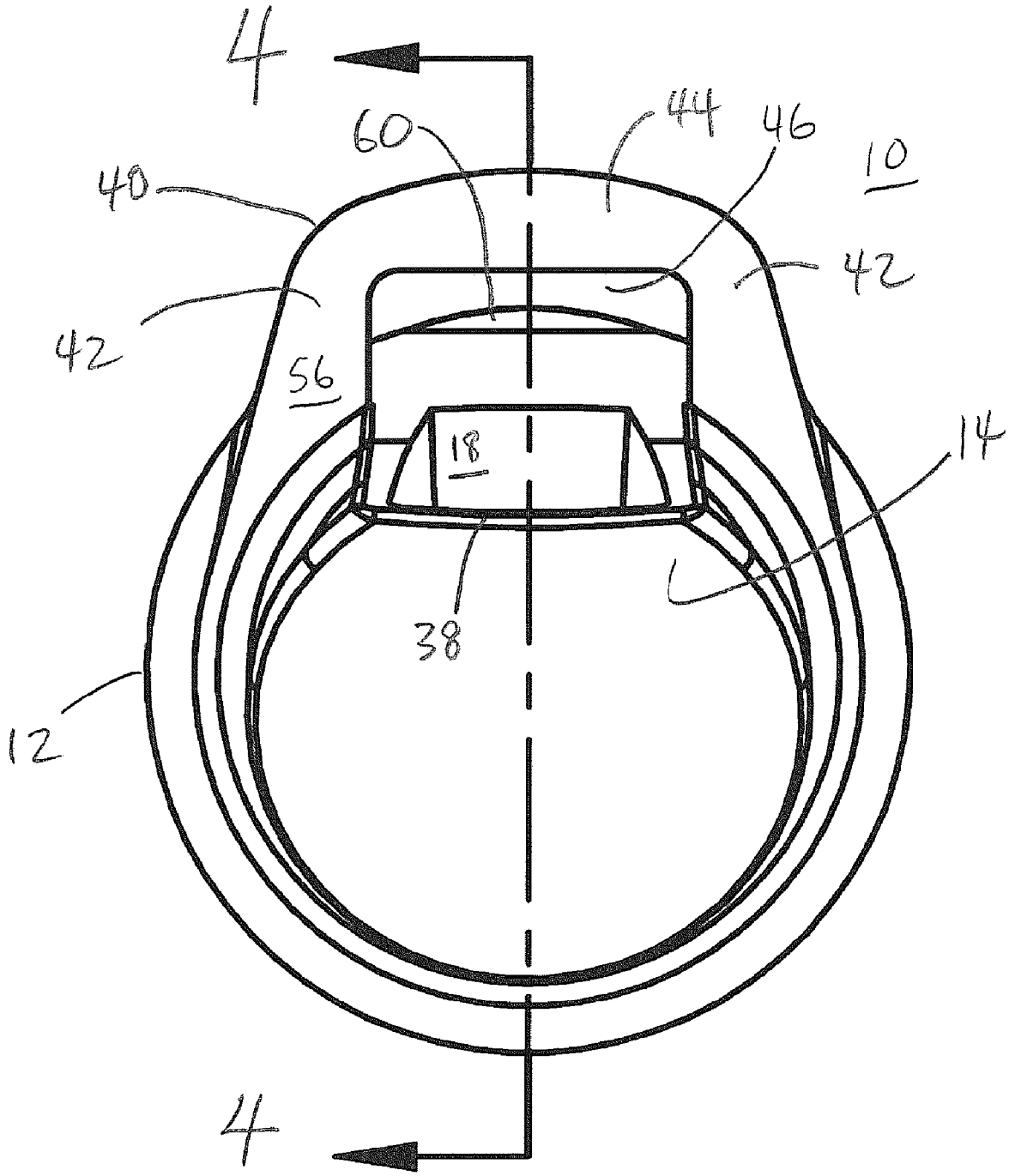
FIG. 3 is a front elevational view of the mouthpiece body appearing in FIG. 2.

In the course of describing the mouthpiece embodiments herein, unless specifically stated otherwise, the front or forward end of the mouthpiece will refer to the end of the mouthpiece that is intended to engage the player's mouth and the rear or rearward end of the mouthpiece will refer to the end of the mouthpiece which engages the instrument. The upper or top side will refer to the side of the mouthpiece which is shown facing upwardly in FIG. 1 and the lower or bottom side of the mouthpiece will refer to the surface which is facing downwardly in FIG. 1. Directions will be indicated according to the long axis of the mouthpiece, for example, axial shall refer to a direction parallel to the long axis of the mouthpiece and transverse shall refer to directions across the long axis of the mouthpiece.

Referring now to FIGS. 1-7, there is shown a first embodiment mouthpiece 10 which includes an elongate body 12 having a first or forward end 14 and a second end 16 opposite the first end. The mouthpiece body 12 defines an axially extending bore or channel 18 having a first opening 20 at the first end 14 and a second opening 22 for fluidic coupling to the bore of a woodwind instrument (not shown). The woodwind instrument may be a conventional single reed woodwind instrument, such as a member of the saxophone family or clarinet family, although nonconventional instruments formed of tubular or hollow materials, such as the training instruments described in the aforementioned U.S. Ser. No. 11/582,174 are also contemplated.

The mouthpiece body 12 includes a flat reed placement surface 24 on which a reed 26 is placed. The reed 26 is preferably a cane reed, although reeds made of other natural or synthetic materials are also contemplated.

The reed 26 includes a flat bottom surface or table 28, which engages the reed placement surface 24. The reed 26 also includes a rearward end or heel section 30, which is intended to be secured to the mouthpiece body 12, and a forward cut or vamped region 32, which is the free end intended to contact the player's mouth and vibrate to produce a tone during use. A middle or spine section 34 is axially disposed between the heel 30 and the vamped area 32. A distal end or tip 36 of the vamped area 32 is intended to be generally aligned with the distal end or tip 38 of the mouthpiece forward end 14.

The mouthpiece body 12 also includes a reed retaining body 40. The reed retaining body 40 is permanently attached to the mouthpiece body 12 and, preferably, the mouthpiece body 12 and the reed retaining body 40 are integrally formed, e.g., via a molding process. The reed retaining body 40 includes first and second vertically upstanding (in the orientation shown in FIG. 1) walls 42, which are axially extending with respect to the mouthpiece body 12. A transverse portion 44 of the reed retaining body 40 extends between the walls 42. The reed placement surface 24 and the reed retaining body 40 cooperate to define an axially extending channel 46, which is sized to receive the heel 30 of the reed 26.

The transverse portion 44 includes an internally threaded or tapped aperture 48 which receives a complimentary threaded set screw or thumb screw 50. The set screw 50 includes a threaded shaft portion 52 which is rotatably received in the opening 48 and an enlarged head portion 54 for manual rotation of the set screw 50.

By rotating the set screw 50 in one direction, the threaded shaft 52 can be advanced downward (in the orientation shown in FIG. 1) with respect to the transverse portion 44 until it bears against the heel section 30 of the reed 26 to exert a retaining force thereon. Rotating the set screw 50 in the opposite direction causes the threaded shaft 52 to be retracted upwardly with respect to the transverse portion 44 thereby allowing the heel section 30 of the reed 26 to be freely removed from or inserted into the axial channel 46.

In operation, when installing the reed 26 on the mouthpiece 10, the set screw 50 is advanced upwardly to allow the heel end 30 of the reed 26 to be inserted into the channel 46. A raised shoulder or lip 60 is formed on the mouthpiece body 12 adjacent the rearward end of the reed placement surface 24 to abut the heel 30 thereby limiting the axial extent of movement of the reed 26 with respect to the axial channel 46 and to prevent passage of the reed completely therethrough.

In the depicted preferred embodiment, the axial position and length of the reed retaining body 40, and the axial position of the shoulder 60 are selected so as to (1) prevent the reed from completely passing through the channel 46; and (2) allow the reed heel 30 to extend beyond a rear edge 58 of the axial channel to allow positioning of the reed 26 on the reed placement surface 24 by manipulating the reed heel 30, as described below.

In the depicted preferred embodiment, the shoulder 60 is a distance D from the tip 38 of the mouthpiece, the distance D being greater than a standard or conventional length C of the reed 26. The rearward end 58 of the reed retaining body 40 is positioned a distance E from the tip 38 of the mouthpiece so that the heel end 30 of the reed axially extends beyond the reed retaining body 40, rearward of the end 58 into a space G defined between the reed retaining body rearward end 58 and the shoulder 60. In the preferred embodiment, the distance G between the reed retaining body rearward end 58 and the shoulder 60 is sufficient to allow the user to manually adjust the position of the reed 26 on the reed placement surface 24 using the heel end 30 of the reed 26, thereby increasing the ease of properly positioning the reed 26 on the mouthpiece.

Commonly, single reed instrument reeds are tapered in width, such that the vamped area 32 has a transverse distance A at the forward end that is wider than a transverse distance B of the heel 30. Thus, the transverse width of the axial channel 46 need only be wide enough to accommodate the heel end 30 of the reed 26. Because the vamped area 32 is delicate, it may be damaged if the reed were allowed to pass through the channel 46 rearwardly a sufficient distance to contact the inward surfaces of the vertical walls 42. Thus, in the illustrated preferred embodiment, a forward edge 56 of the reed retaining body 40 should be positioned at a distance F from the shoulder 60 which is sufficiently close to the shoulder 60 so as to prevent the reed vamped area 32 from entering the axial channel 46 when the heel 30 abuts the shoulder 60. In a preferred embodiment, the difference between the vertical height (in the orientation shown in FIG. 4) of the channel 46 at the rear end 58 and the height of the shoulder 60 is less than the thickness of the heel portion 30 of a standard or conventional reed 26.

Figure 4:
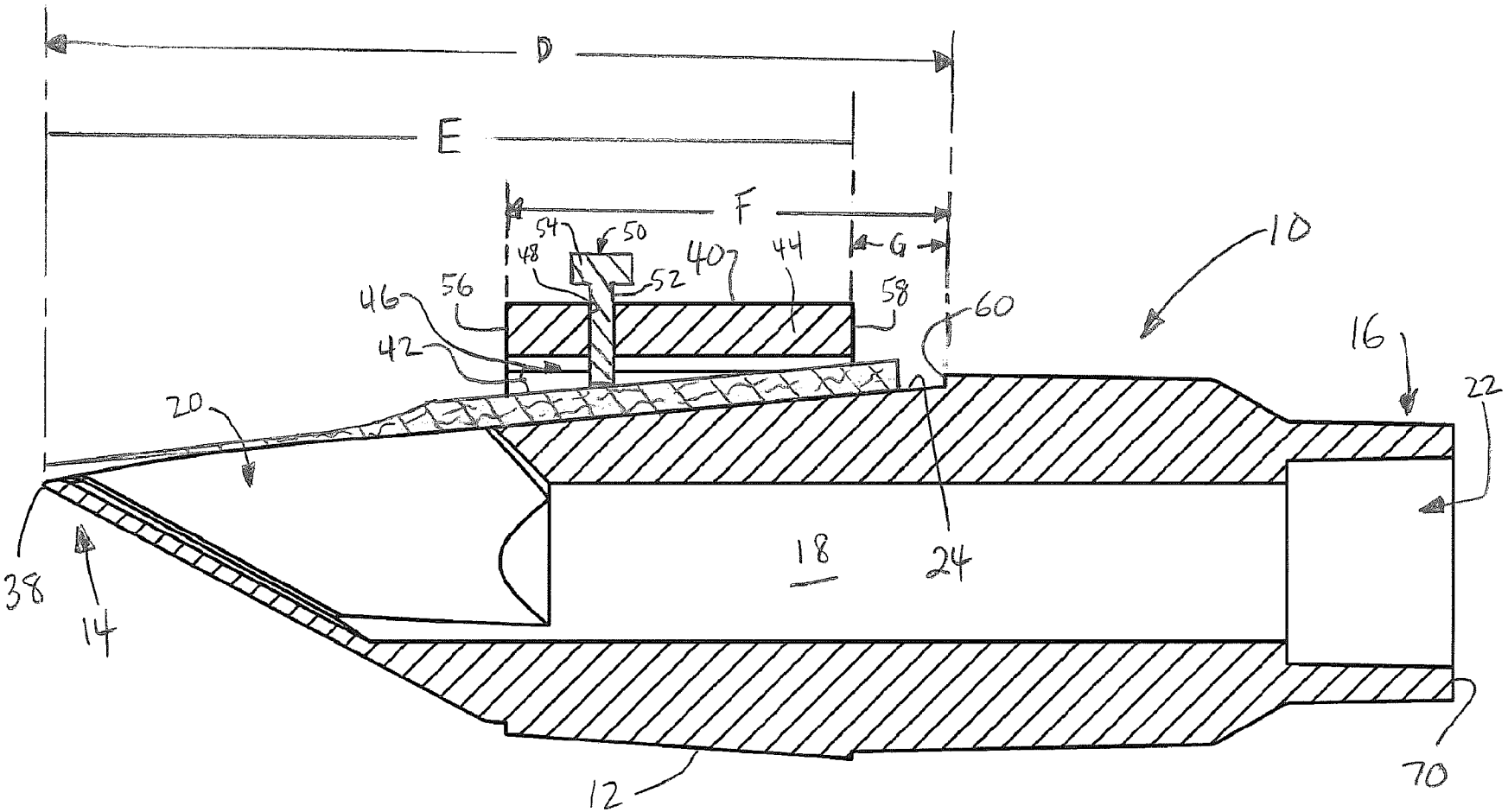
FIG. 4 is side cross-sectional view taken along the lines 4-4 in FIG. 3, but with the reed and set screw in place.
Figure 5:
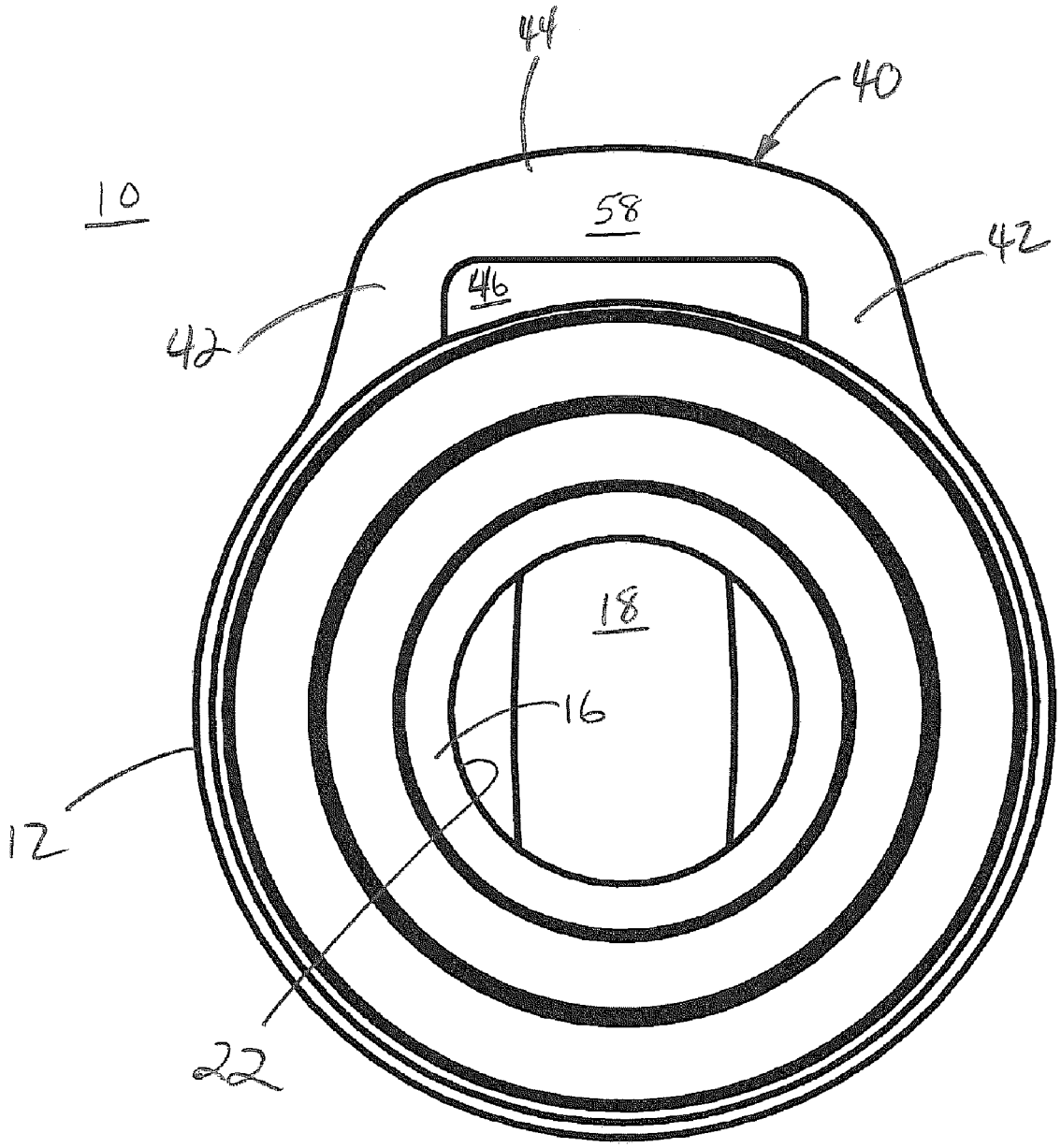
FIG. 5 is a rear elevational view of the mouthpiece body appearing in FIG. 2.
Figure 6:
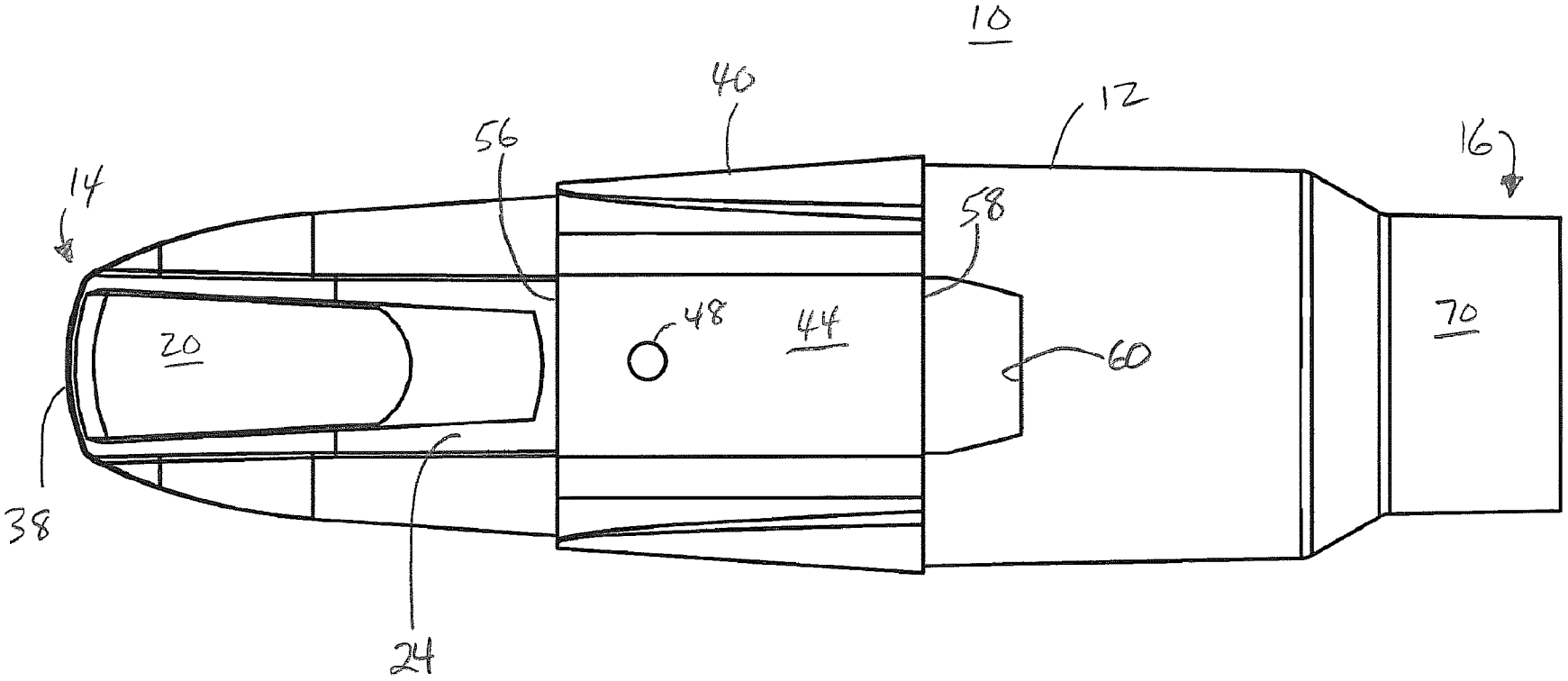
FIG. 6 is top plan view of the mouthpiece body appearing in FIG. 2.
Figure 7:
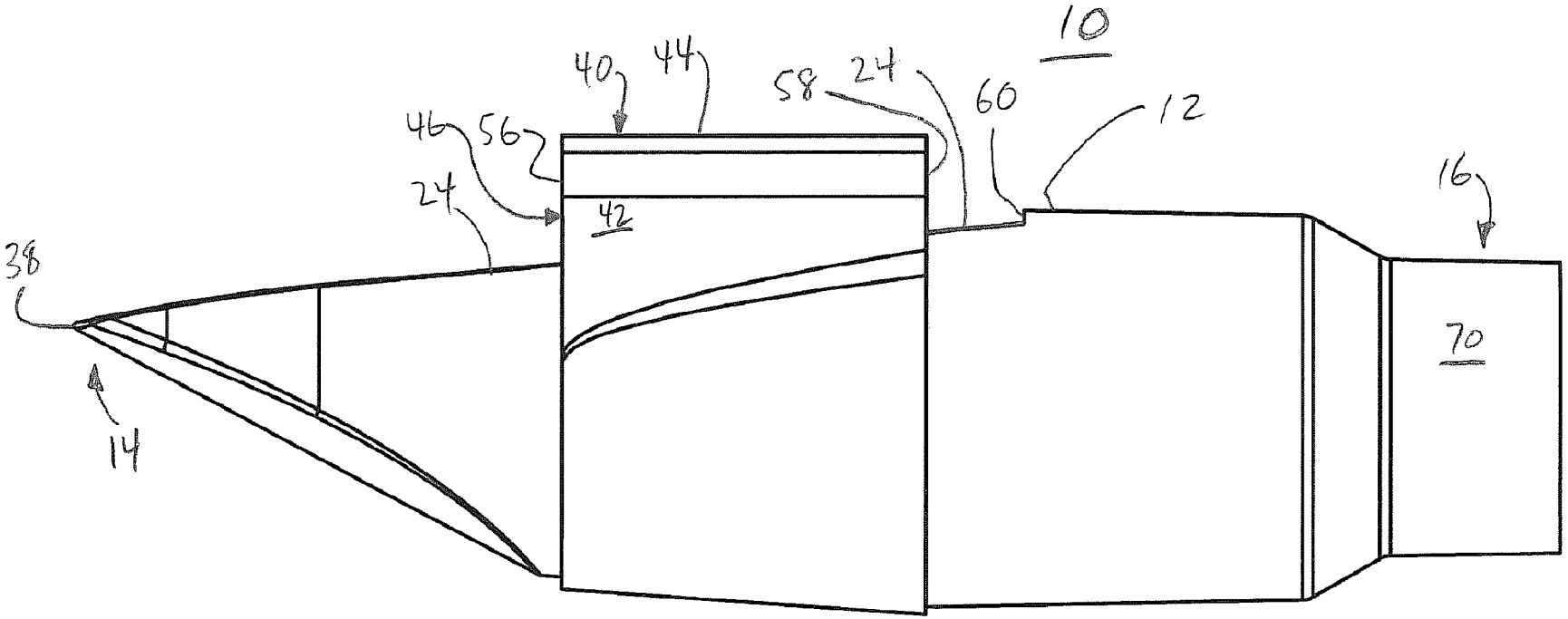
FIG. 7 is a side elevational view of the mouthpiece body appearing in FIG. 2.

In the depicted preferred embodiment, the vertical (in the orientation shown in FIG. 1) opening of channel 46 is greater at the forward edge 56 than it is at the rearward edge 58. That is, as best seen in FIG. 4, the reed placement surface 24 is inclined with respect to the transverse portion 44 to provide an axial channel 46 in which the channel height is tapered to increade outwardly toward the front end 38 of the mouthpiece 10. This has two advantages. First, the wider opening at the end 56 makes it easier to insert the reed 26 into the axial channel 46, while the narrower opening at the rearward end 58 constrains movement of the heel end 30 away from the reed placement surface 24. In the depicted preferred embodiment wherein difference between the height of the channel 46 at the rearward end 58 and the height of the shoulder 60 is less than the thickness of the heel portion 30, the heel end 30 is prevented from moving past the shoulder 60. Second, when removing the reed 26, if the mouthpiece 10 (or an instrument carrying the mouthpiece 10) is held so that the thumb screw 50 is facing downward, the reed will fall away from the mouthpiece reed placement surface 24 as the thumb screw 50 is loosened. This allows the reed 26 to be grasped by its transverse edges to remove it from the channel 46, which helps protect the tip 36 of the reed 26 from damage.

Figure 8:
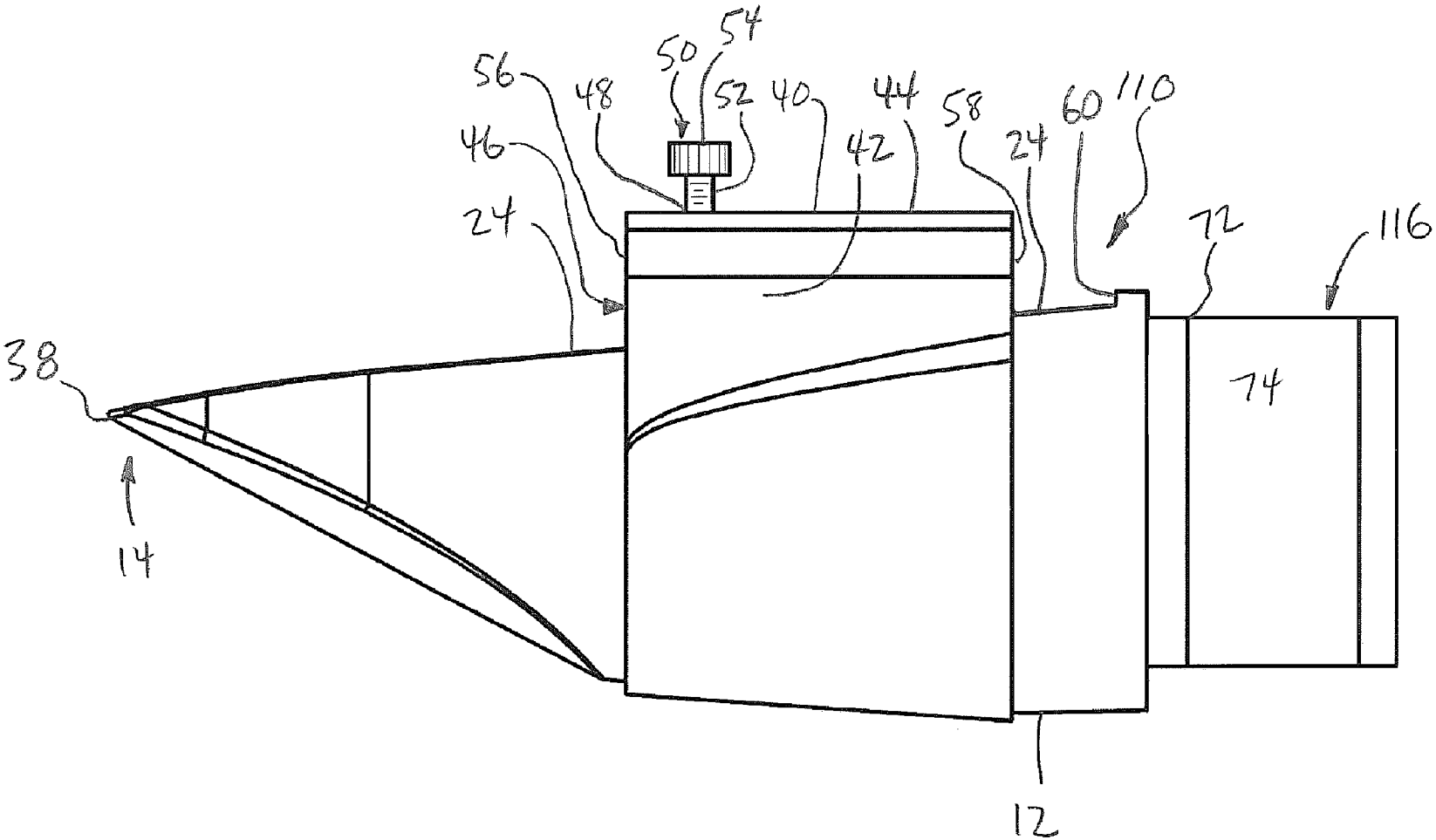
FIG. 8 is a side elevational view of a mouthpiece body in accordance with a second exemplary embodiment.

The end 16 of the mouthpiece body 12 is adapted to couple the air passageway 18 of the mouthpiece 10 to the bore of a woodwind instrument. In the embodiment appearing in FIGS. 1-7, the end 16 forms an outer sleeve 70 defining the cavity 22 for internally and coaxially receiving an instrument end, that is, a saxophone type mouthpiece end. Other means for connecting the mouthpiece to an instrument are also contemplated. For example, an alternative embodiment having a clarinet type mouthpiece end is shown in FIG. 8 and described in greater detail below. In still further embodiments, the mouthpiece could be integrally formed with the body of the instrument.

Instrument mouthpieces contact the user's mouth and, therefore, must be used hygienically, particularly in a school setting, e.g., where school owned instruments may be used by more than one student. The instrument mouthpiece 10 herein is particularly advantageous in that it is readily cleaned. To clean, the mouthpiece 10 is simply dipped, with the reed 26 removed, into a cleaning or disinfecting solution, rinsed, and dried or allowed to dry. Because the forward and rearward edges 56 and 58 of the reed retaining body are completely open, cleaning and rinsing fluids will drain off the mouthpiece 10 after cleaning and rinsing.

In FIG. 8 there is shown an alternative embodiment mouthpiece 110 which has a mouthpiece end 116, which is a clarinet type mouthpiece end, that is, the mouthpiece end 116 is adapted to be coaxially received within an outer sleeve or receptacle on the instrument. The mouthpiece end 116 includes an annular groove 72 having a ring or band formed of cork or other resilient or high friction material 74 to provide an airtight and secure coupling between mouthpiece and instrument. The mouthpiece 110 and the features and advantages thereof are otherwise as described above by way of reference to FIGS. 1-7, and like reference numerals appearing in FIG. 8 are as described above by way of reference to FIGS. 1-7. The above description of such features, advantages, and like reference numerals applicable to FIGS. 1-7 also applicable to FIG. 8 are incorporated here.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An instrument mouthpiece comprising:

a mouthpiece body defining an air passageway;

a reed placement surface defined on said mouthpiece body adjacent said air passageway;

a reed retaining body formed on said mouthpiece body for removably securing a reed to said mouthpiece, said reed retaining body including first and second upstanding walls and a transverse portion extending therebetween;

said reed retaining body and reed placement surface defining an axially extending channel for receiving a heel end of the reed;

said transverse portion including a tapped opening rotatably receiving a threaded fastener, said threaded fastener rotatable in a first direction for selectively advancing said threaded fastener toward the reed placement surface and rotatable in a second direction for selectively retracting said threaded fastener away from the reed placement surface; and a shoulder axially adjacent said reed placement surface providing a stop for preventing passage of the reed completely through the axially extending channel.

2. The instrument mouthpiece of claim 1, further comprising:

said shoulder axially displaced rearwardly from the axially extending channel a sufficient distance to permit manual positioning of the reed on the reed placement surface using the heel end of the reed.

3. The instrument mouthpiece of claim 2, further comprising:

said shoulder positioned sufficiently close to a front end of the mouthpiece so as to prevent the vamped area of the reed from entering the channel when the heel end of the reed abuts said shoulder.

4. The instrument mouthpiece of claim 1, further comprising:

said reed placement surface inclined with respect to said reed retaining body to define a tapered construction wherein said axially extending channel has a reduced channel height at a first end of said axially extending channel adjacent said shoulder and an increased channel height at a second end of said axially extending channel opposite said first end.

5. The instrument mouthpiece of claim 4, wherein the difference between the height of the axially extending channel at the first end and a height of said shoulder is less than the thickness of the heel end of the reed.

6. The instrument mouthpiece of claim 1, wherein the instrument mouthpiece is selected from a clarinet mouthpiece and a saxophone mouthpiece.

7. A musical instrument comprising:

an instrument body defining an internal bore; and a mouthpiece coupled to said instrument body, said mouthpiece defining an air passageway which is in fluid communication with said internal bore;

said mouthpiece including:

a reed placement surface defined on said mouthpiece body adjacent said air passageway;

a reed retaining body formed on said mouthpiece body for removably securing a reed to said mouthpiece, said reed retaining body including first and second upstanding walls and a transverse portion extending therebetween;

said reed retaining body and reed placement surface defining an axially extending channel for receiving a heel end of the reed;

said transverse portion including a tapped opening rotatably receiving a threaded fastener, said threaded fastener rotatable in a first direction for selectively advancing said threaded fastener toward the reed placement surface and rotatable in a second direction for selectively retracting said threaded fastener away from the reed placement surface; and a shoulder axially adjacent said reed placement surface providing a stop for preventing passage of the reed completely through the axially extending channel.

8. The musical instrument of claim 7, further comprising:

said shoulder axially displaced rearwardly from the axially extending channel a sufficient distance to permit manual positioning of the reed on the reed placement surface using the heel end of the reed.

9. The musical instrument of claim 8, further comprising:

said shoulder positioned sufficiently close to a front end of the mouthpiece so as to prevent the vamped area of the reed from entering the channel when the heel end of the reed abuts said shoulder.

10. The musical instrument of claim 7, further comprising:

said reed placement surface inclined with respect to said reed retaining body to define a tapered construction wherein said axially extending channel has a reduced channel height at a first end of said axially extending channel adjacent said shoulder and an increased channel height at a second end of said axially extending channel opposite said first end.

11. The musical instrument of claim 10, wherein the difference between the height of the axially extending channel at the first end and a height of said shoulder is less than the thickness of the heel end of the reed.

12. The musical instrument of claim 7, wherein the musical instrument is selected from a member of the clarinet family and a member of the saxophone family.

13. The musical instrument of claim 7, wherein said mouthpiece and said instrument body are integrally formed.

14. The musical instrument of claim 7, wherein said mouthpiece is removably attached to said instrument body.

15. A method of manufacturing an instrument mouthpiece comprising:

molding a mouthpiece body defining an air passageway, said mouthpiece body having a reed placement surface defined on said mouthpiece body adjacent said air passageway; a reed retaining body formed on said mouthpiece body said reed retaining body including first and second upstanding walls and a transverse portion extending therebetween; said reed retaining body and reed placement surface defining an axially extending channel; and a shoulder axially adjacent said reed placement surface providing a stop for preventing passage of the reed completely through the axially extending channel; and forming an internally threaded opening in said transverse portion and rotatably inserting an externally threaded fastener into said internally threaded opening.

* * * * *